United States Patent [19]

Bakermans

[11] 3,931,838

[45] Jan. 13, 1976

[54] BUNDLE STRAPPING TOOL

[75] Inventor: Johannes Cornelis Wilhelmus Bakermans, Etters, Pa.

[73] Assignee: AMP Incorporated, Harrisburg, Pa.

[22] Filed: Nov. 25, 1974

[21] Appl. No.: 526,550

[52] U.S. Cl. ..... 140/123.6; 140/93.2

[51] Int. Cl.[2] ..... B21F 9/02

[58] Field of Search ..... 140/123.6, 93.2; 81/9.3

[56] References Cited

UNITED STATES PATENTS

| | | | |
|---|---|---|---|
| 3,610,296 | 10/1971 | Kabel | 140/93.2 |
| 3,810,499 | 5/1974 | Benfer | 140/93.2 |
| 3,853,155 | 12/1974 | Kabel | 140/93.2 |

*Primary Examiner*—Lowell A. Larson

*Attorney, Agent, or Firm*—William J. Keating; Jay L. Seitchik; Frederick W. Raring

[57] ABSTRACT

A tool adapted to receive the free end of a self-locking bundle tie formed of stainless steel or the like which has a loop disposed about a bundle of articles such as electrical wires or cables. The tool is provided with a handle which is manually reciprocated to operate the tool. In operation the tool will initially tighten the loop about the bundle of articles by applying tension to the free end of the bundle tie. After the desired tension is achieved within the loop, continued operation of the tool will cause the tension applied to the free end of the bundle tie to be relaxed, the free end of the bundle tie to be subsequently cut adjacent the loop. The tool is a compact hand tool designed to cut stainless steel bundle ties with a minimum of force.

18 Claims, 13 Drawing Figures

BUNDLE STRAPPING TOOL

FIELD OF THE INVENTION

The present invention relates generally to hand tools or the like designed for tightening a bundle tie about a plurality of articles to a predetermined value and to subsequently cut the free end of the bundle tie which extends away from the loop disposed about the articles.

BACKGROUND OF THE INVENTION

Tools are well-known for tightening the loop of a bundle tie around a plurality of wires and other similar articles and for subsequently severing the excess strap. Examples of such tools are shown in U.S. Pat. Nos. 3,610,296, 3,830,263 and Re26,492. All of the above patented tools receive the free end of a bundle tie which has a loop disposed about a plurality of articles such as electrical wires or cables, tighten the loop about the articles by applying tension to the free end of the bundle tie, and subsequently cut the free end of the bundle tie closely adjacent to the loop which has been tensioned about the bundle of articles. None of the above patents are particularly suitable for tightening loops of bundle ties which are made of stainless steel or the like. For example, Re26,492 maintains tension upon the free end of the strap during the severing of the strap. This results in requiring additional force to cut the strap and may also cause the strap to tear during cutting. U.S. Pat. Nos. 3,610,296 and 3,830,263 both disclose tools which release the tension on the free end of the bundle tie after the desired tension has been received within the loop and which subsequently cut the free end of the bundle tie. However, in both of these designs, the tensioning takes place during a first portion of the movement of the handle of the tool and the cutting takes place only during a second portion of the movement of the handle. While these tools will perform in a satisfactory manner, it should be observed that a greater force may be required on the handle to cut the strap than with the tool of the present invention. Thus, only a small portion of the movement of the handle is utilized to cut the free end of the strap in the prior art patents, while a significantly greater proportion of the movement of the handle of the present invention may be utilized to cut the strap. Also, the prior art tools do not utilize the full stroke of the handle to tighten the strap, while the tool of the present invention may utilize the full stroke of the handle to tighten the strap. Furthermore, the designs of these tools do not lend themselves to the compact design of the present tool.

OBJECTS AND SUMMARY OF THIS INVENTION

It is a principal object of the present invention to provide a compact hand tool suitable for tensioning a loop of a bundle tie about a bundle of articles and for subsequently cutting the free end portion of the loop.

More particularly, it is an object of the present invention to provide a hand tool for tensioning a self-locking stainless steel bundle tie or the like about a bundle of articles such as electrical wires and cables and to subsequently sever the free end of the strap with minimum force requirements.

It is another object of the present invention to provide a hand operated tool adapted to tension the loop of a self-locking stainless steel bundle tie about a plurality of articles wherein a substantially full movement of the handle may be utilized to tension the loop, the tool being adapted to cut the free end of a bundle tie after the desired tension has been achieved through a similar corresponding movement of the handle of the tool.

The above objects, and further objects and advantages, are attained by providing a tool having a longitudinally extending frame with one end adapted to be disposed adjacent the bundle which has the loop portion of a self-locking bundle tie disposed about the bundle, the other end of the longitudinally extending frame carrying a handle. The free end of the self-locking bundle tie is inserted into an aperture in the tool between plate means and tensioning means. The tensioning means include a bell crank lever strap engaging mechanism which carries pawl means and the plate means, mounting means for mounting the bell crank lever mechanism for reciprocal movement and also for swinging movement between a first tension applying position and a second position, reciprocal means interconnected with the mounting means and operable to reciprocate the mounting means and the bell crank lever mechanism to cause the bell crank lever mechanism to exert tension on the free end of the bundle tie during reciprocation in one direction when the bell crank lever mechanism is in its first tension applying position, and force applying means normally operable to maintain the bell crank lever mechanism in its first position. The tool further includes cutting means operable to cut the free end of the bundle tie only after the ball crank lever mechanism has been shifted to its second position, the cutting means being caused to be operated by structure which interconnects the reciprocal means with the cutting means, and actuator means which includes a manually engagable reciprocal handle.

The objects set forth above and other objects and advantages in this invention will be apparent to those skilled in the art after a consideration of the following detailed description, taken in conjunction with the accompanying drawings in which a preferred form of this invention is illustrated.

IN THE DRAWINGS

DETAILED DESCRIPTION OF A PREFERRED EMBODIMENT

Figure 1:
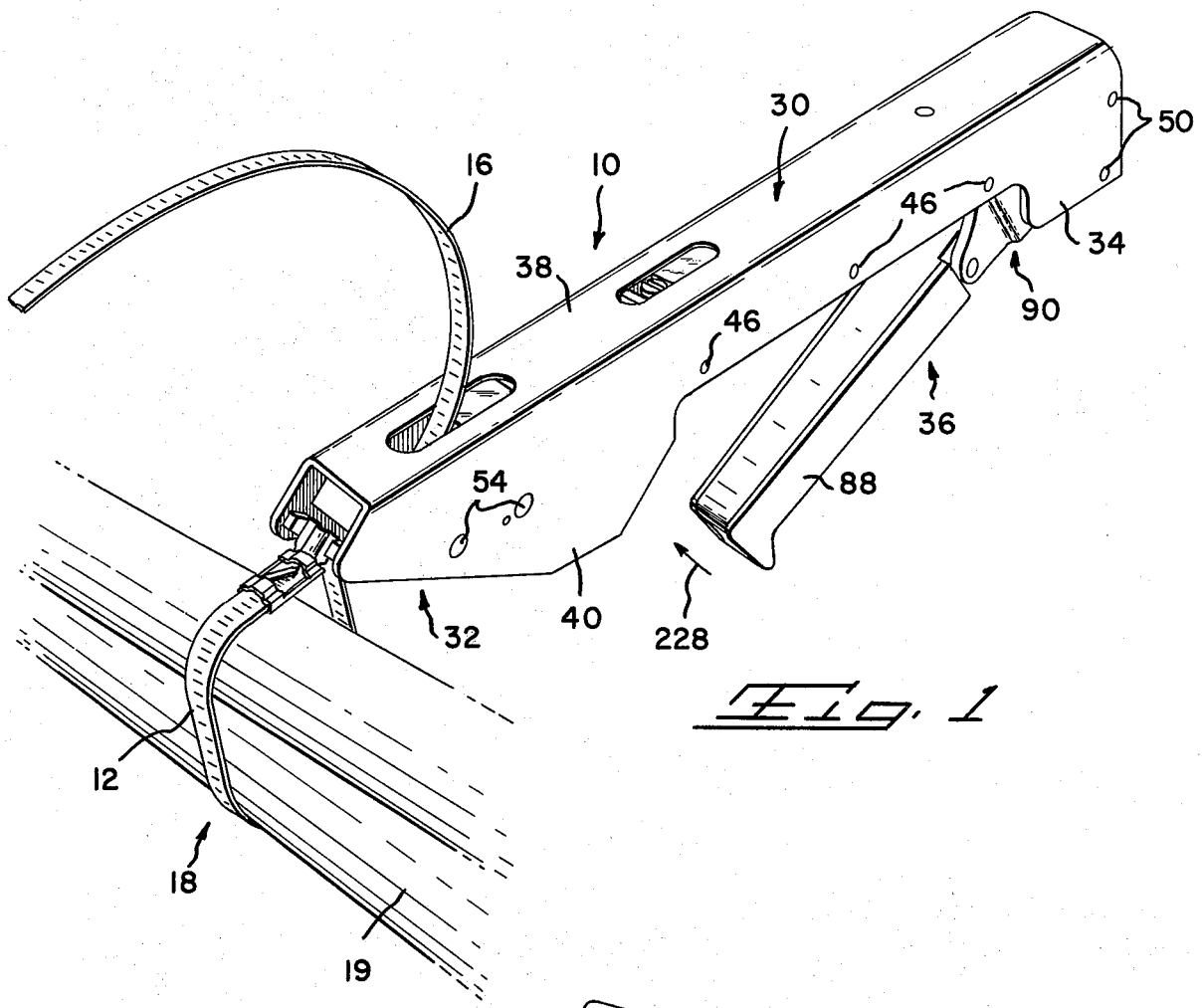
FIG. 1 is a perspective view showing the tool of this invention disposed adjacent a plurality of articles about which the loop of a self-locking bundle tie has been disposed, the tool being shown with the free end of the bundle tie extending through an aperture within the tool.
Figure 2:
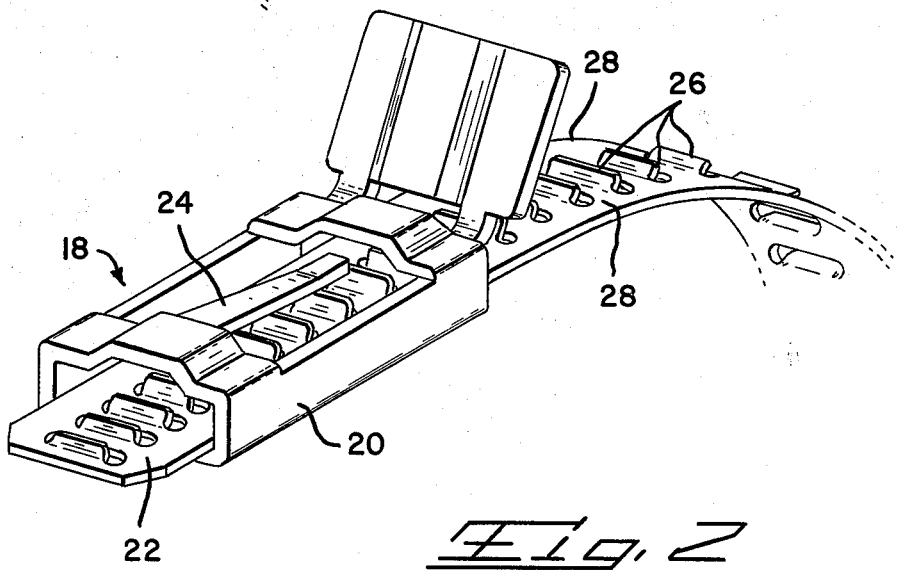
FIG. 2 is an enlarged perspective view showing a portion of the self-locking bundle tie shown in FIG. 1.

Referring first to FIGS. 1, 2, 11 and 12, the tool of this invention, which is indicated generally at 10, is adapted to tighten or tension the loop portion 12 of a self-locking bundle tie about a plurality of articles 14, which may be electrical wires or cables, and to subsequently cut the free end portion 16, of the bundle tie, which is indicated generally at 18, after the desired tension has been achieved within the loop. The bundle tie 18 is preferably formed of stainless steel or the like and is of the type shown in U.S. Pat. application Ser. No. 399,644 filed Sept. 21, 1973. The bundle tie includes a clip portion 20 which is secured by spot welding or the like to one end 22 of the bundle tie strap in the manner indicated in FIG. 2, the clip portion having an overlying portion which includes a resilient spring element 24. When securing the bundle tie 18 about a plurality of articles, the free end portion 16 of the bundle tie is inserted within the clip portion from a left to right direction as viewed in FIG. 2 to form a loop which is disposed about the articles, and the free end portion is then pulled to the right to initially tension the loop of the bundle tie about the bundle to hand tightness. The bundle tie strap, which is preferably formed of stainless steel, is provided with a plurality of upwardly extending vanes 26 spaced inwardly of peripheral edge portions 28. The vanes of the one end 22 of the bundle strap will interengage with the corresponding vanes of that portion of the strap which is disposed above them to form a self-locking structure so that the portion of the strap which is disposed above the one end of the bundle tie strap 22 cannot be moved in a left-hand direction as viewed in FIG. 2. In this regard, the resilient spring element 24 will bear against the upper strap to cause it to become interengaged with the lower strap.

The tool of this invention includes a main frame portion, indicated generally at 30, which is adapted to have one end, indicated generally at 32, disposed adjacent the bundle of articles, the other end, indicated generally at 34, being interconnected with actuator means 36. The one end 32 of the tool is provided with an aperture or channel through which the free end portion 16 of the bundle tie can be received in the manner indicated in FIG. 5. The main frame portion 30 has a generally inverted U-shape and includes an upper generally horizontal portion 38 and opposed depending side portions 40, 42 which are integral with the upper portion 38. The lower edges of an intermediate section the side portions 40, 42 are interconnected to a longitudinally extending member 44 by fasteners 46, a pivot block 48 is disposed between the side portions 40, 42 adjacent the other end 34 of the tool and is secured in place by fasteners 50, and similarly, a mounting block 52 is secured adjacent the one end of the frame portion between the side portions 40, 42 by fasteners 54. Various operative components of the tool are mounted within the frame on the longitudinally extending member 44, the pivot block 48 and the mounting block 52. These operative components include plate means indicated generally at 56, tensioning means indicated generally at 58, cutting means indicated generally at 60, a back latch mechanism indicated generally at 62 (FIG. 6), and the actuator means 36.

Figure 3:
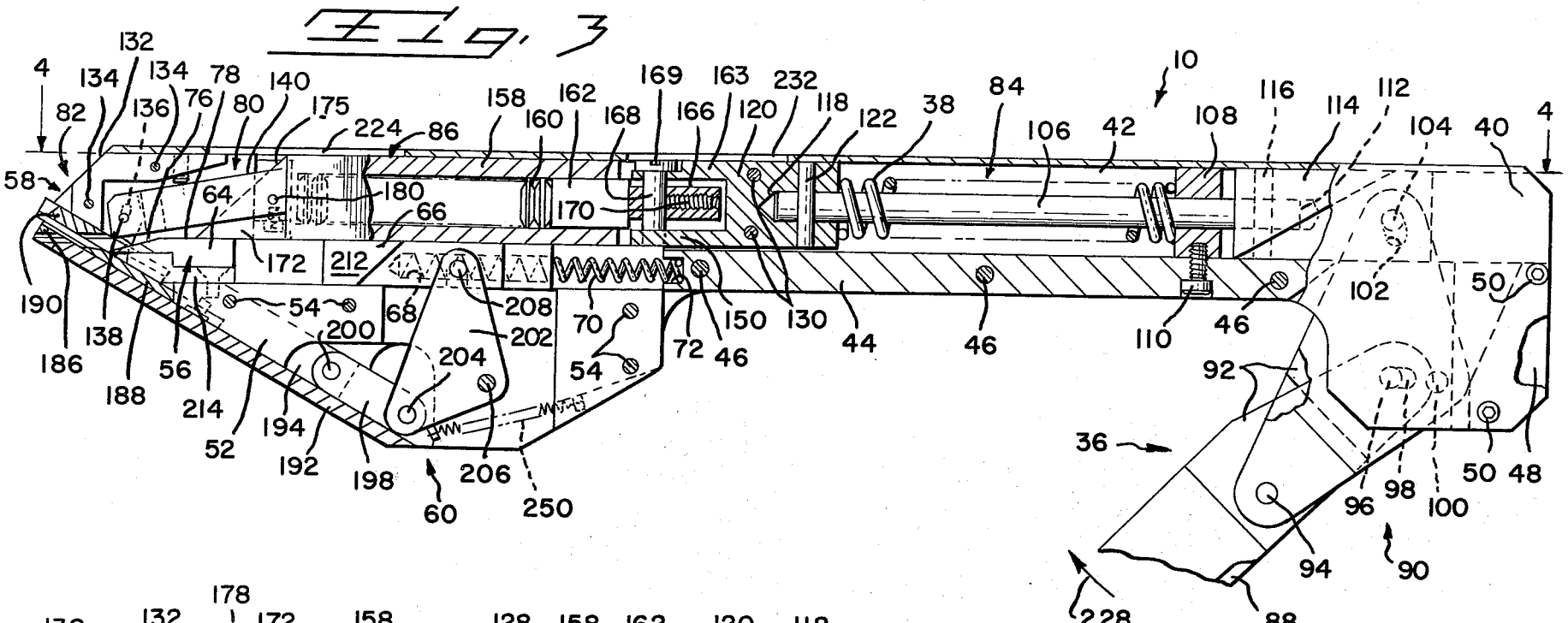
FIG. 3 is a side view of the tool shown in FIG. 1 with portions being sectioned.
Figure 5:
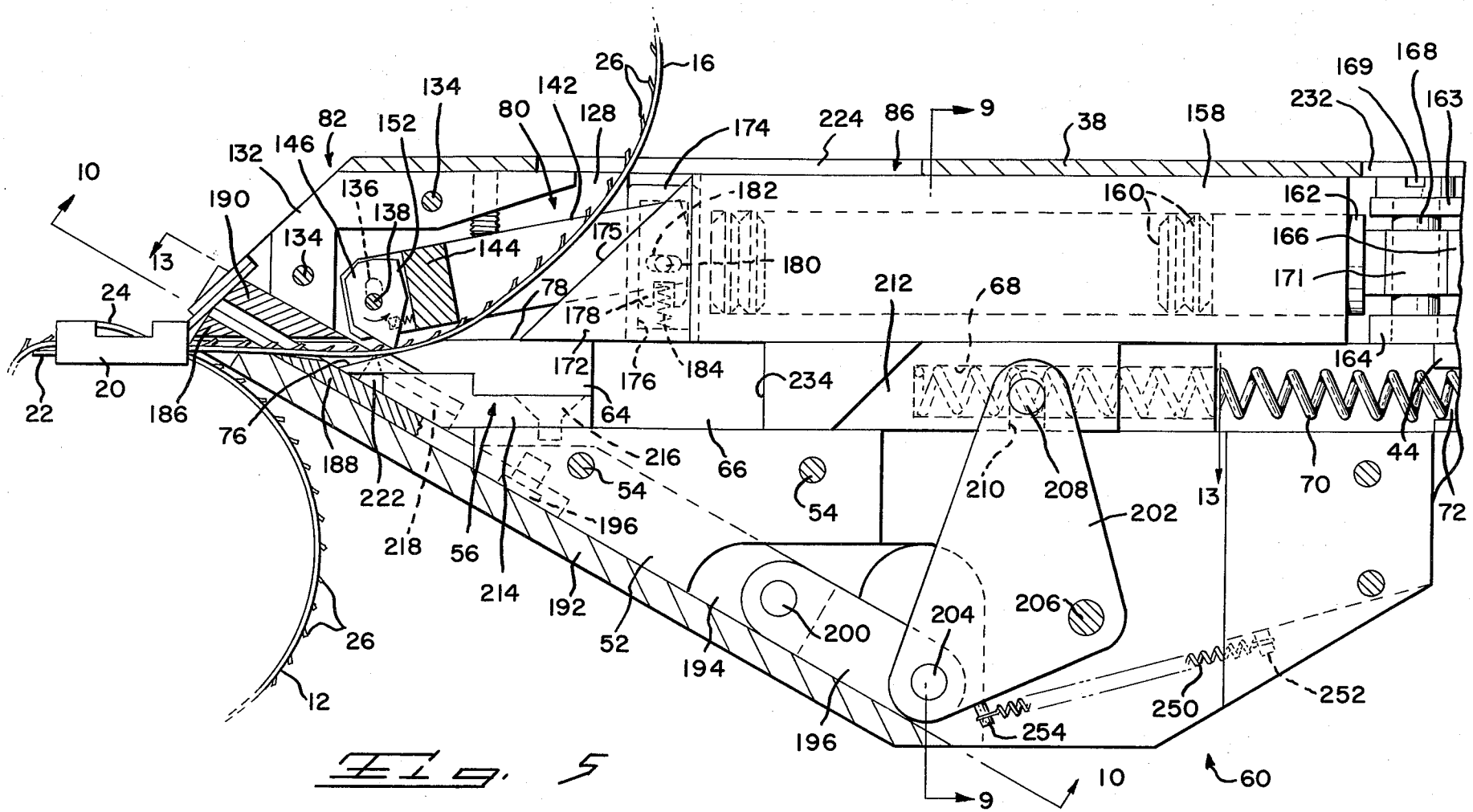
FIG. 5 is an enlarged sectional view of the end of the tool which is adapted to be disposed adjacent the bundle, the parts being shown in their initial position.
Figure 6:
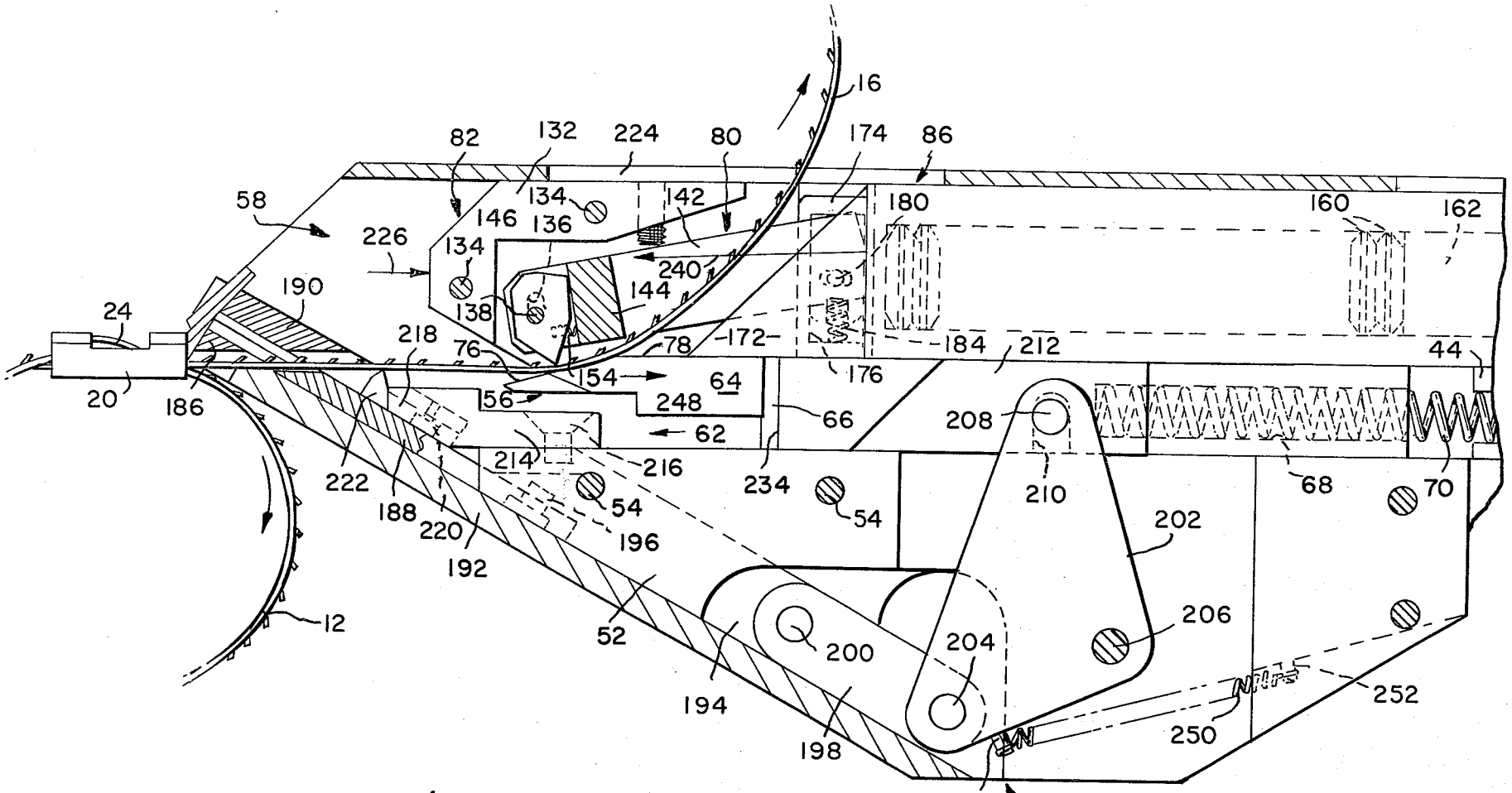
FIG. 6 is a view similar to FIG. 5 showing the disposition of the parts of the tool as tension is initially being applied to the free end of the bundle tie to cause the loop of the bundle tie to be tightened about a plurality of articles.
Figure 9:
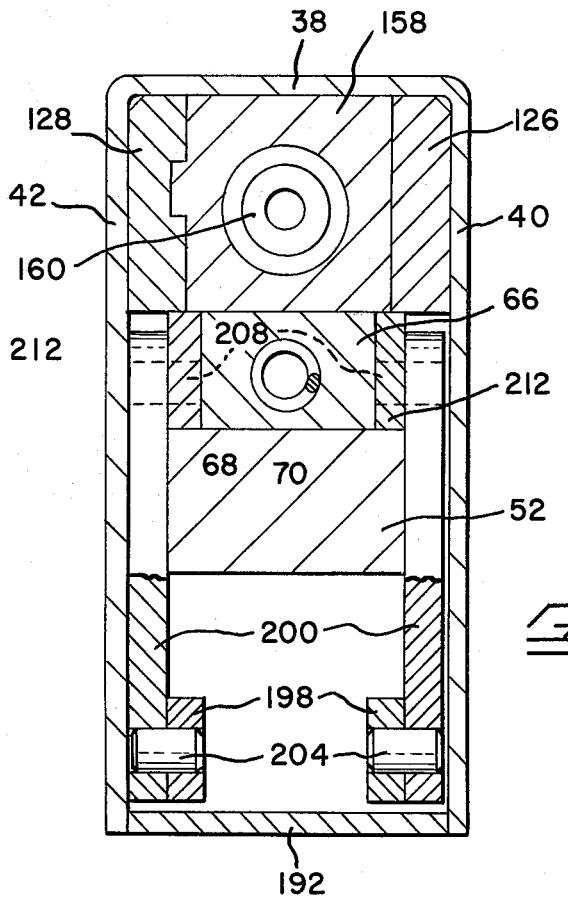
FIG. 9 is a section taken generally along the line 9—9 in FIG. 5.
Figure 10:
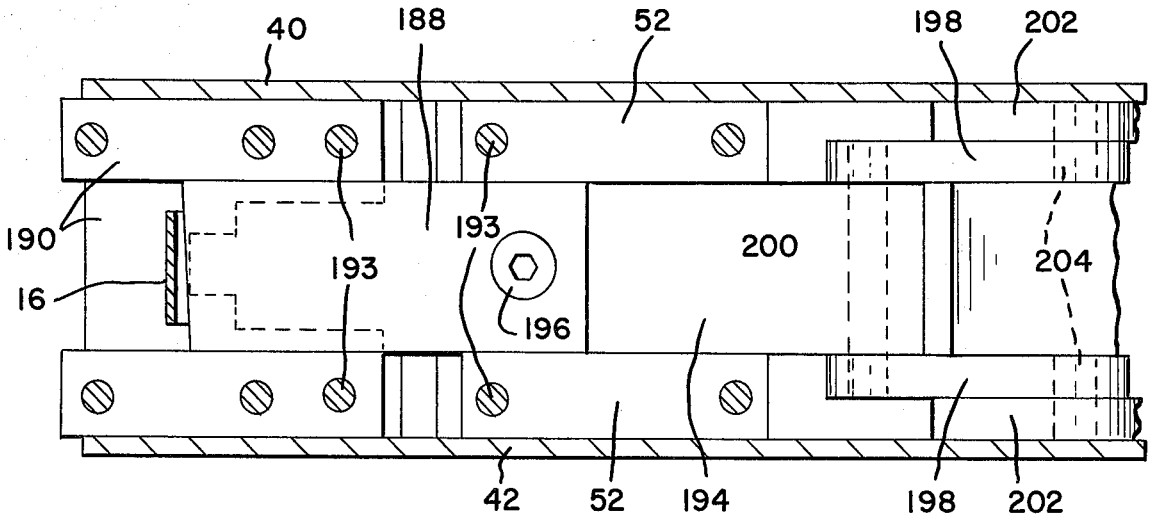
FIG. 10 is a sectional view taken generally along the line 10—10 in FIG. 5.

The plate means 56 is slidably mounted on the mounting block 52 within the frame for reciprocal movement between a left-hand position such as that shown in FIG. 5 and a right-hand position such as that shown in FIG. 6. The plate means includes a first portion 64 and a second portion 66. The second portion 66 has a width less than the width of the mounting block as can best be seen from FIGS. 9 and 13 and is provided with an aperture 68 open to the right-hand side for the reception of one end of a compression spring 70. The other end of the compression spring 70 is received within an aligned aperture 72 of the left-hand end of the longitudinally extending member 44. The compression spring will normally bias the plate means 56 to its left-hand position shown in FIG. 3.

Figure 13:
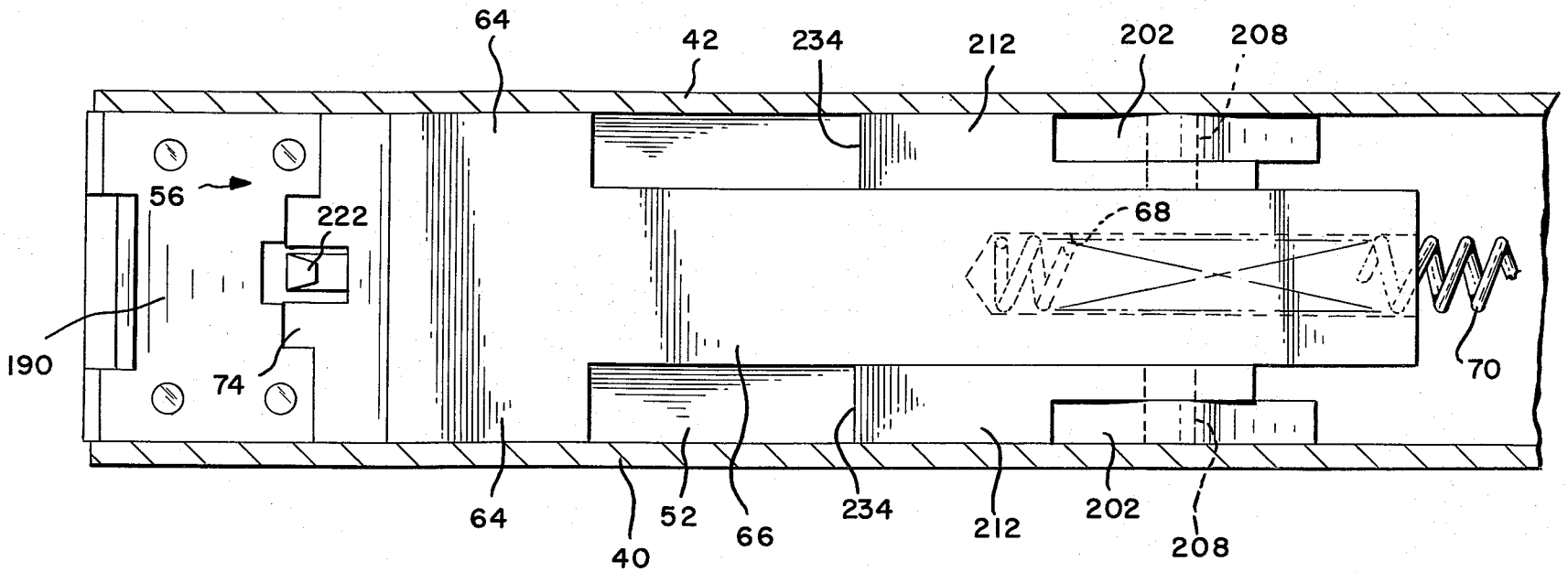
FIG. 13 is a section taken generally along the line 13—13 in FIG. 5.

The first portion 64 of the plate means has a width only slightly less than the spacing between the side portions 40, 42 of the frame throughout most of its length as can best be seen from FIG. 13. However, the first portion does have a reduced width section 74 which extends into a portion of the cutting means, the reduced width portion being provided with a notch 75 through which a portion of the back latch mechanism may extend. As can be seen from FIG. 5, for example, the depth of the first portion 64 is not as great as the depth of the second portion 66, and thus only the portion 66 is in contact with the mounting block 52. The first portion is provided with first and second upper surfaces 76, 78 which are disposed at an obtuse angle relative to each other, the second surface being disposed parallel to the movement of the plate means 56. The function of the plate means will be brought out in the discussion of the operation of the tool.

The tensioning means 58 includes a strap engaging bell crank lever mechanism 80, mounting means for mounting the strap engaging mechanism within the frame for the either reciprocal movement or for swinging movement between first and second positions, the mounting means being indicated generally at 82, reciprocal means which are operable to reciprocate the mounting means and the bell crank lever mechanism towards and away from the bundle tie, the reciprocal means being indicated generally at 84, and force applying means indicated generally at 86. The tensioning means 58 is caused to be operably reciprocated in one direction by the actuator means 36, the actuator means being interconnected to the reciprocal means 84.

The actuator means 36 includes a handle 88 which is interconnected withh a force multiplying linkage assembly which is indicated generally at 90. The force multiplying linkage assembly includes a pair of bell crank plates 92 which have an end portion pivotally secured to an intermediate portion of the handle 88 by a pivot pin 94. An end of the handle 88 is also interconnected with the pivot block 48 by means of a pivot pin 96 which is received in a cylindrical aperture in the end of the handle and an elongated aperture 98 in the pivot block. An intermediate portion of each of the bell crank plates 92 is pivotally secured to the pivot block 48 by pivot pins 100. The other end of the bell crank plates 92 is provided with an elongated slot 102 which is adapted to receive a transversely extending pivot pin 104 carried by a portion of the reciprocal means.

The reciprocal means includes a reciprocal draw bar 106 which has a portion received within a longitudinally extending bore of a spacer 108 which is in turn rigidly secured to the longitudinally extending member 44 by a fastener 110. The right-hand end of the draw bar 106 is received within an aligned aperture 112 of a slide block 114 and is rigidly secured thereto by means of a roll pin 116 or the like. The slide block 114 is also provided with a transversely extending aperture which receives the transversely extending pin 104 of the actuator means 36. The left-hand end of the draw bar 106 is similarly received within an aperture 118 of another slide block 120 and is secured thereto by a roll pin or the like 122. A compression spring 124 is disposed about the draw bar 106 with one end bearing against the fixed spacer 108 and the other end bearing against the slide block 122. The compression spring will act to bias the slide block 120 in the left-hand direction, as can be appreciated from an inspection of the drawings.

The mounting means 82 includes a pair of guide plates or slides 126, 128, the right-hand ends of the guide plates being secured to opposite sides of the slide block 120 by fasteners 130, and the left-hand end of the slides 126, 128 being interconnected to each other by a spacer 132, which is secured in place by fasteners 134. To the right of the spacer 132 the slides 126, 128 are provided with a pair of elongated slots 136 which receive opposed ends of a pivot pin 138. An intermediate portion of the strap engaging bell crank lever mechanism 80 is supported by the pivot pin 138 for swinging movement about the pivot pin 138 as the ends of the pivot pin move upwardly and downwardly within the slots 136, the strap engaging bell crank lever mechanism being shiftable between a first operative position shown in FIGS. 5 and 6 to a second position shown in FIGS. 7 and 8.

Figure 4:
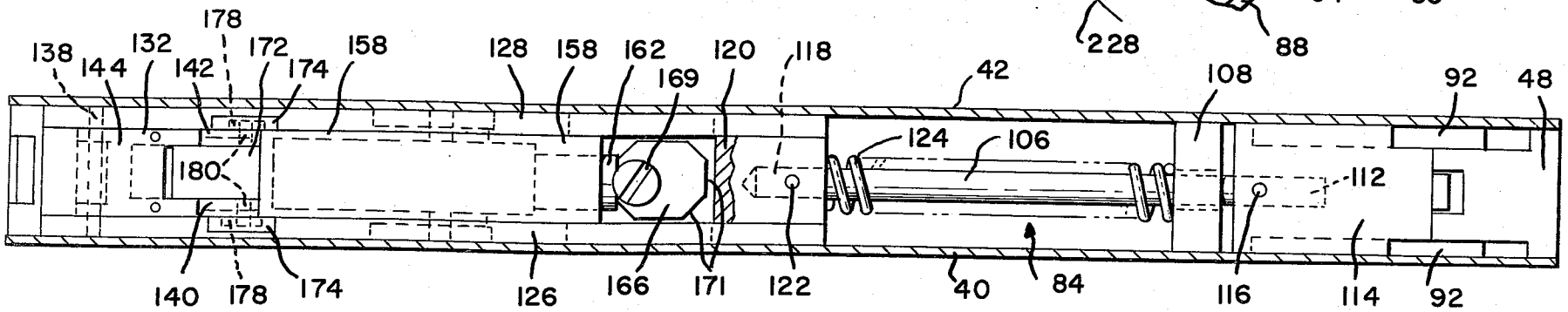
FIG. 4 is a section taken generally along the lines 4—4 in FIG. 3.
Figure 11:
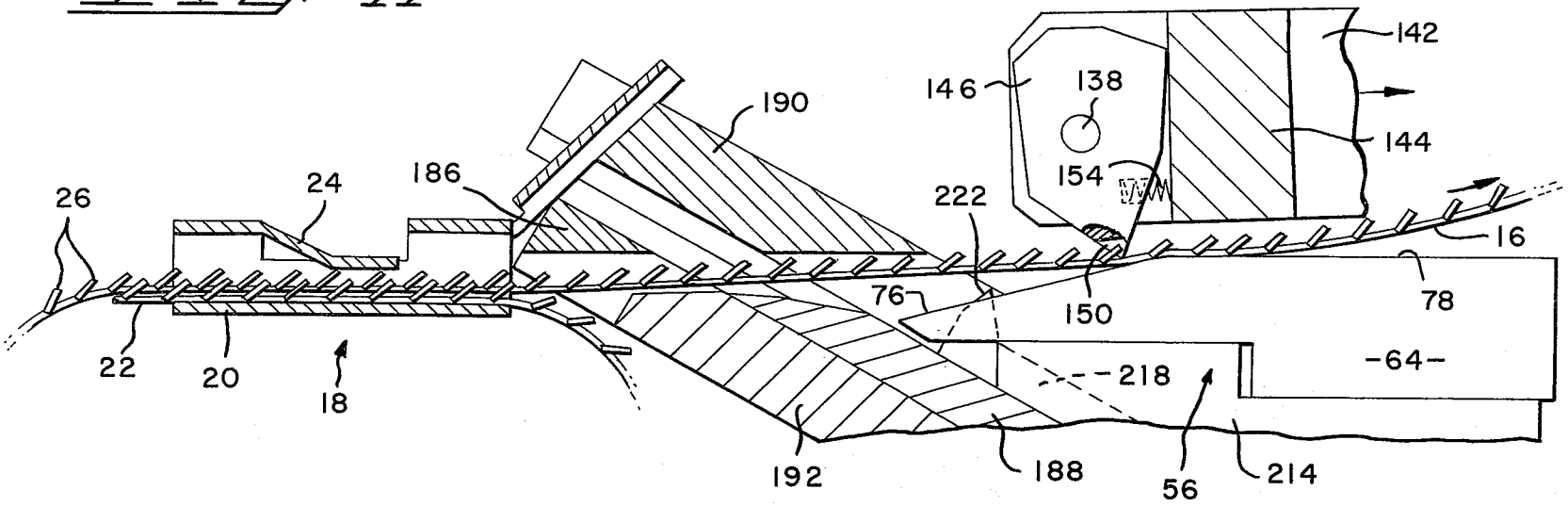
FIG. 11 is an enlarged view showing the disposition of various parts of the tool the instant before the desired tension within the loop is achieved.
Figure 12:
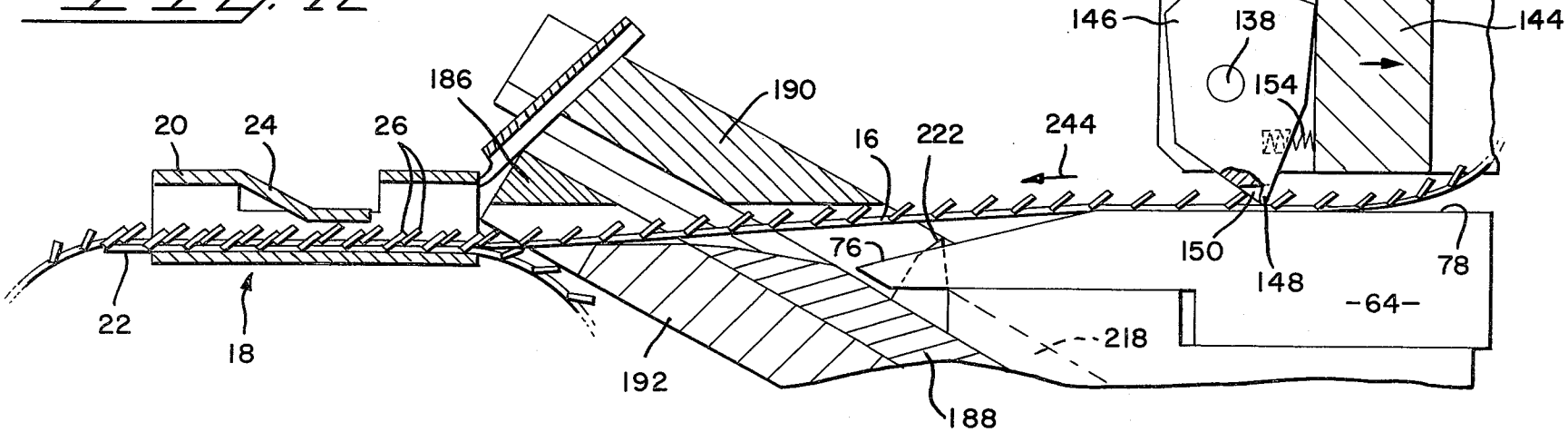
FIG. 12 is a view similar to FIG. 11 showing the disposition of various parts of the tool the instant before the free end of the strap is severed.

The strap engaging bell crank lever mechanism 80 includes a pair of spaced apart plates 140, 142 (FIGS. 4 and 9), an intermediate portion of the plates being interconnected to each other by a spacer 144, the spacer being interconnected with the plates by fastener means not shown. The left-hand end of the plates 140, 142 are apertured and receive the pivot pin 138. Pawl means 146 are journalled about the pin 138 between the plates 140, 142, the pawl means being provided with a channel (no number) between two spaced apart pawl projections 148, 150 (FIGS. 11 and 12). The pawl projections 148, 150 are adapted to engage the peripheral edge portions 28 of the strap 16 to either side of the vanes, the vanes passing through the channel. The pawl means 146 can pivot about the pin 138 between the position shown in FIG. 5 and the position in FIG. 6. In this connection it should be noted that the pawl means is provided with an upper surface 152 which is adapted to abut the left-hand surface of the spacer 144 when in the position shown in FIG. 6. Furthermore, compression spring means 154 are provided which normally bias the pawl means into the position shown in FIG. 6, one end of the compression spring means bearing against the left-hand surface of the spacer 144, and the other end of the compression spring means bearing against the bottom of a recess provided in the pawl means 146.

The force applying means 86 is mounted between the slide block 120 of the reciprocal means and the right-hand end of the bell crank lever mechanism, and the force applying means is also disposed between the slides 126, 128. The force applying means will normally bias the strap engaging means in a counter-clockwise direction as viewed in the FIGS. about the pivot pin 138 to dispose the mechanism 80 in its first position. However, the tensioning of the strap will impart a clockwise force to the bell crank lever mechanism, and when the clockwise force equals or exceeds the force imparted to the bell crank lever mechanism by the force applying means the bell crank lever mechanism will then rotate in a clockwise direction as the ends of the pivot pin move upwardly within the slots until the bell crank lever mechanism attains the second position shown in FIGS. 7 and 8. The force applying means 86 includes a spring holder 158 which is provided with a bore which receives a plurality of Belleville washers 160 which act as compression spring means to normally bias the spring holder away from the slide block 120. The right-hand end of the bore in the spring holder receives a cylindrical spacer 162. Adjustable means are provided to vary the force exerted by the force applying means, and to this end the left-hand end of the slide block 120 is provided with upper and lower extensions 163 and 164 and a cam 166 is received within the extensions. The cam is secured to a vertically extending shaft 168 which is journalled for rotation within bores of the upper and lower extensions 163 and 164, and the upper end of the shaft is slotted as at 169, the cam being secured to the shaft by means of a fastener 170. The cam is provided with a plurality of faces 171 spaced varying distances from the axis of rotation of the shaft 140. By turning the cam the force exerted by the force applying means may be varied which will in turn vary the tension applied to the strap in a manner which is more fully set forth below. The left-hand end 172 of the spring holder is of a reduced width and extends between the plates 154, 156, the reduced width portion being provided with an upwardly inclined surface 175 which is utilized to guide the end of the free end portion 16 through the apertue within the left-hand end of the tool as it is being initially inserted into the tool. The full width portion of the spring holder 158 abuts against the right-hand end of each of the plates 140, 142.

The strap engaging mechanism is provided with means to engage the cutting means only when the strap engaging means is in its second position. To this end each of the slides 126, 128 is provided with a vertically extending channel portion open to the side of the spaced apart plates 140, 142. A slide 174 is received within each of these channels, and each of the slides 174 is in turn provided with a vertically extending channel closed at both ends, the vertically extending channel 176 receiving a plate 178 which is in turn interconnected to the right-hand end of each of the plates 140, 142 by a pivot pin 180 which is received within an elongated aperture 182 of each of the plates 178. A compression spring 184 is disposed between the lower end of each of the plates 178 and the bottom of the associated vertically extending channel 176 to cause the slide 174 to be normally biased to a lower position.

The cutting means includes a stationary shear blade 186 and a movable shear blade 188. The stationary shear blade is interconnected with the mounting block 52 by means of a cutter guide plate 190, a lower plate 192 and fasteners 193. The movable shear blade is in turn interconnected to a movable mounting member 194 by a fastener 196. The movable mounting member 194, the fastener 196 and the movable shear blade 188 are mounted within a channel defined by spaced apart portions of the mounting block 52 and the lower plate 192. The movable mounting member is in turn interconnected to one end of a pair of spaced apart links 198 by pivot pin means 200, and the other end of the pair of spaced apart links are in turn interconnected to an end of a pair of spaced apart bell crank levers 202 by further pivot means 204. An intermediate portion of each of the bell crank levers 204, which are disposed on opposite sides of the mounting block 52, is pivotally secured to the mounting block 52 by pivot means 206. The other end of each of the bell crank levers 202 carries a pivot member 208 which is received within a vertically extending slot 210 of a slide 212, there being two slides, one disposed to either side of the second portion 66 of the plate means 56.

The back latch mechanism includes a back latch holder 214 which is secured to the mounting block 52 by a fastener 216 and a back latch member 218 which is in turn secured to the back latch holder 214 by a fastener 220, the back latch member being provided with an upwardly projecting portion 222.

OPERATION

After the loop portion 12 of a bundle tie 16 has been formed around a plurality of articles, the free end portion 16 of the bundle tie is fed through the left-hand end of the tool, the free end of the bundle tie being disposed between the pawl means 146 and an upper surface 76 of the first portion 64 of the plate means 56 with an end portion of the free end strap portion extending through an aperture 224 in the upper surface 38 of the main frame. Initially the free end portion is pulled through the tool as far as possible and the tool is moved to the left to dispose its left-hand end adjacent the clip portion 20, as can best be seen from FIG. 5.

To tighten the loop about the plurality of articles the tensioning means is reciprocated from the left to the right in the direction of the arrow 226 until the desired tension is attained within the loop portion, during which movement the free end of the strap is caused to be tensioned as the bell crank mechanism is moving in the direction of the arrow 226 in FIG. 6. During tensioning movement the pawl projections 148, 150 will engage peripheral portions 28 of the free end of the strap to either side of the vanes 26 and hold the strap tightly against the inclined upper surface 76 of the plate means 56. During reciprocation of the tensioning means in a direction opposite to the arrow 226 the free end of the strap 16 will bow down slightly and the upwardly projecting portion 222 of the back latch mechanism will pass between two of the vanes 26 of the strap to hold the strap under tension. The tensioning means is caused to be moved in the direction of the arrow 226 by engaging the handle 88 and swinging it in the direction of the arrow 228. As the handle 88 is moved in the direction of the arrow 228 the force multiplying linkage assembly will engage the reciprocal means 84 to move it and the other parts of the tensioning means away from the bundle tie. If the handle is released, the compression spring 124 will in turn cause the reciprocal means to move in an opposite direction to cause the other parts of the tensioning means to move towards the bundle tie. It should be noted that before the handle is reciprocated, the desired tension which is to be attained within the loop is adjusted by turning the slotted end 169 of the shaft 168 with a screwdriver or the like to dispose one of the surfaces 175 of the cam 166 in contact with the spacer 162. In this connection it should be noted that another aperture 232 is provided in the upper surface 38 of the frame above the shaft 168 for this purpose. In one model of this invention the desired tension can be varied within a range of 20 to 80 pounds. However, other ranges of tension can be provided for by varying the Belleville washers.

Figure 7:
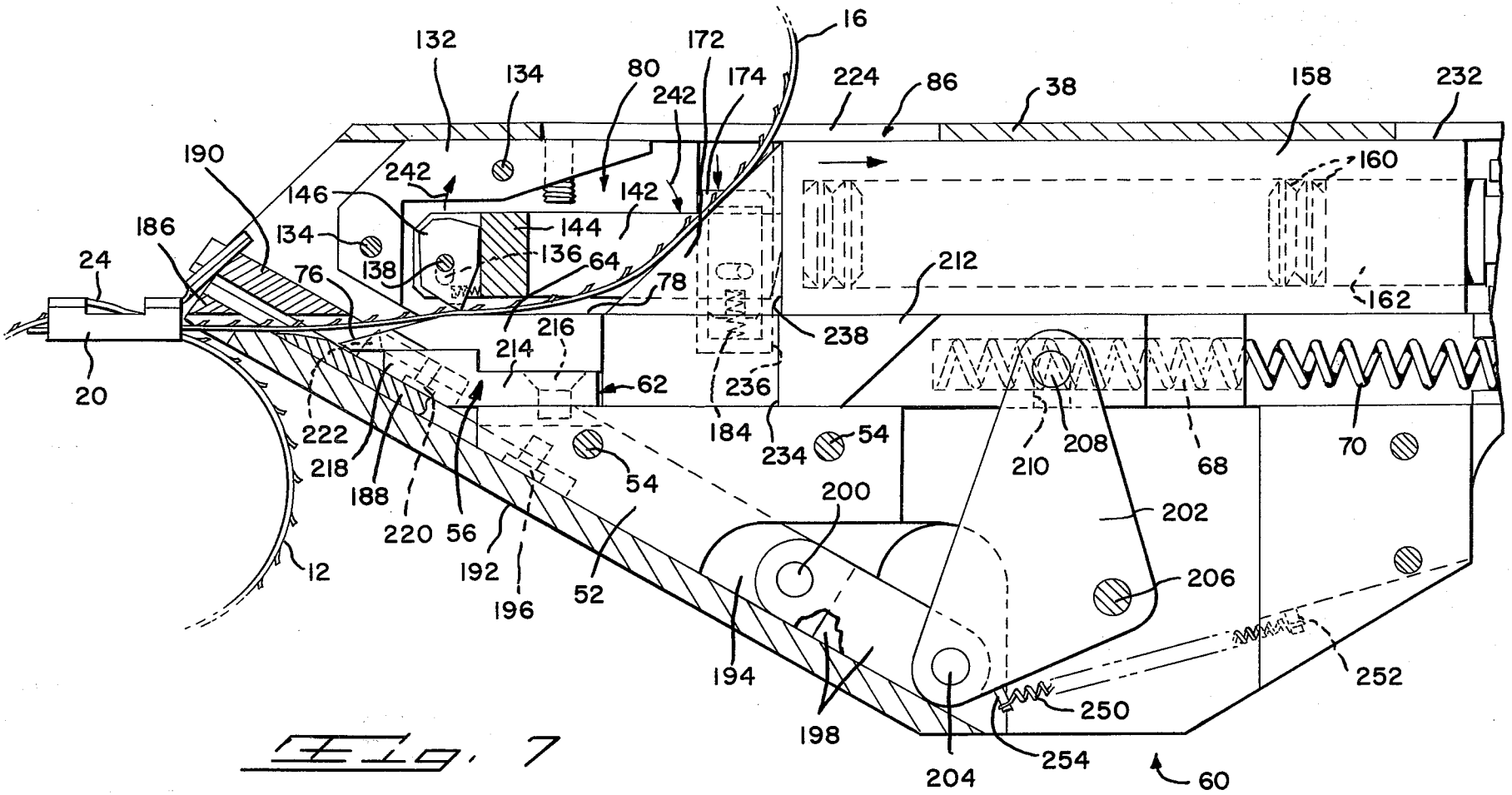
FIG. 7 is a view similar to FIG. 6 showing the disposition of the parts as a predetermined tension is achieved within the loop and immediately prior to the actuation of the cutting mechanism.
Figure 8:
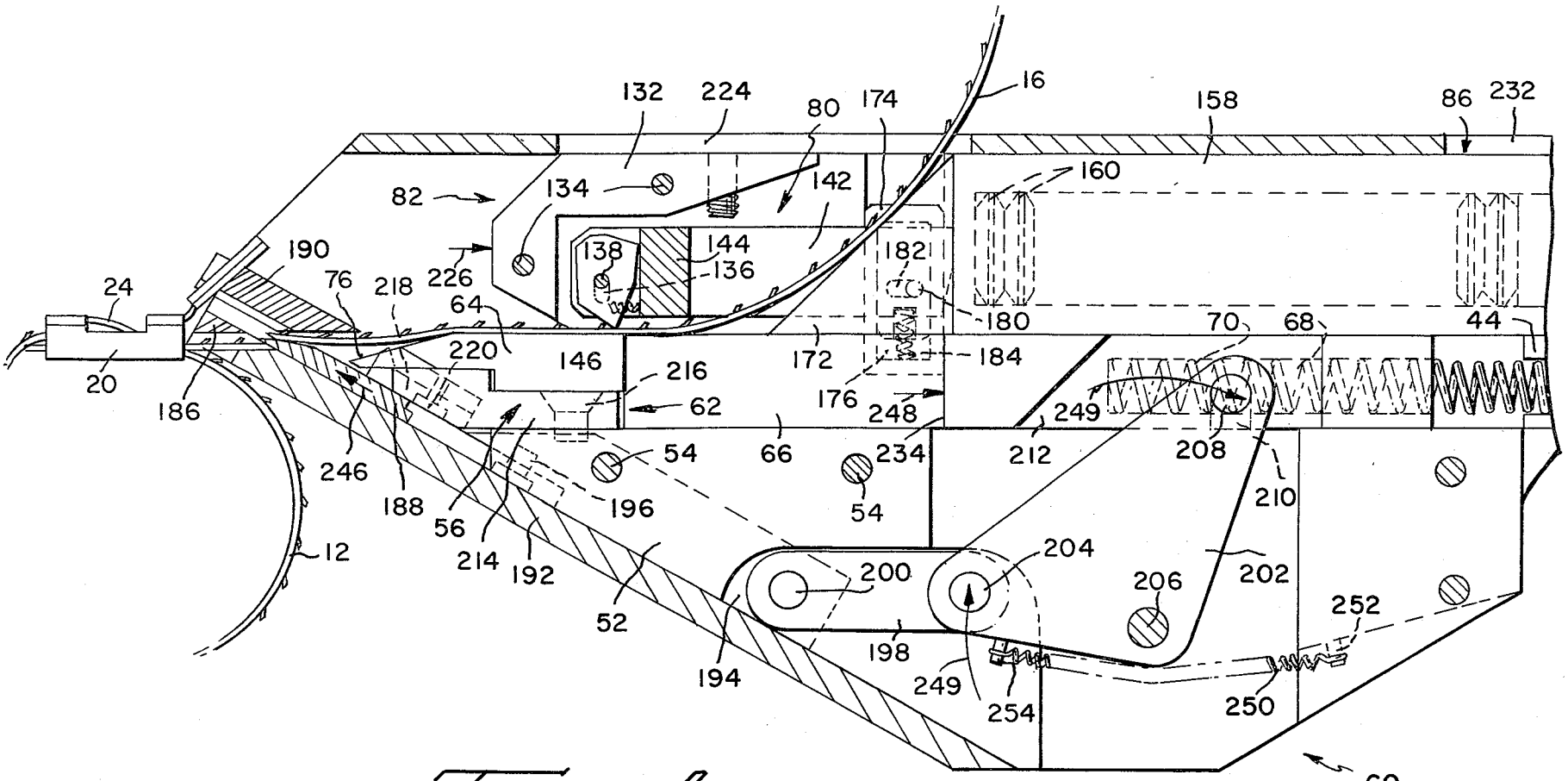
FIG. 8 is a view similar to FIG. 7 showing the manner in which the free end of the bundle tie is cut.

As it has been brought out above, the strap engaging bell crank lever mechanism 80 is swingably and shiftably mounted on the mounting means 82 for movement between a first tension applying position, which is shown for example in FIGS. 6 and 11, and a second position, which is shown for example in FIGS. 7 and 12. When the bell crank lever mechanism is in its first position it will apply tension to the free end of the strap during movement of the tensioning means in the direction indicated by the arrow 226. However, when the desired tension is achieved, further movement of the tensioning means in the direction of the arrow 226 will cause the bell crank lever mechanism to be shifted to its second position as the force applying means is compressed, the tension on the free end of the strap now being relaxed. As the strap engaging mechanism is shifted to its second position, the right-hand surface of the slide 174, which serves as abutment means, may contact the left-hand surface 234 of the slide 212 to cause the cutting means to be actuated during further movement in the direction of arrow 226.

The force applying means 86 will normally maintain the bell crank lever mechanism 80 in its first position as long as the opposed force imposed upon the bell crank lever mechanism by the tension force within the strap does not exceed the preselected force of the springs 160. Thus, the left-hand end 238 of the spring holder 158 is biased into engagement with the right-hand end of the spaced apart plates 140, 142 of the strap engaging mechanism 80. As the resulting force line 240 (FIG. 6) is spaced above the pivot pin 138, the bell crank lever mechanism will have a counter-clockwise rotational force imposed upon it. As long as the opposed force imparted to the strap engaging mechanism by the tension in the strap does not exceed the force of the force applying means during movement of the tensioning means in the direction of the arrow 226 the strap engaging mechanism 80 will be maintained in its first position. Thus, when the parts are moved in the direction of the arrow 226, the pawl projections 148, 150 will engage the peripheral edge portions of the strap 16 to either side of the vanes 26 and hold these portions of the strap tightly against the sloping surface 76 of the plate means 56. During such movement, when the bell crank lever mechanism is maintained in its first position, the plate means will shift with the free end of the strap from the left-hand position shown in FIG. 5 to the right-hand position shown in FIG. 6 as the strap 16 is trapped between the pawl projections 148, 150 and the inclined surface 76. The tensioning means, when moved in the direction of the arrow 226, will exert tension on the free end of the strap, and this tension force will react through the pawl projections 148, 150 to tend to rotate the bell crank mechanism in a clockwise direction, indicated by the arrows 242, to its second position. When the opposed force imposed upon the bell crank lever mechanism by the tension within the free end of the strap 16 exceeds the pre-selected force of the force applying means, the force applying means will be compressed permitting the bell crank lever mechanism to shift from its first position to its second position with the pivot means 138 riding upwardly within the slots 136 until the bell crank lever mechanism is in the position shown in FIG. 7. As the right-hand end of the bell crank lever mechanism has now been shifted downwardly, and as the pivot means has been shifted upwardly, the resulting force imposed by the force applying means will pass substantially closer to the pivot means 138. This will cause the tension within the strap to be relaxed. It should also be appreciated that as the bell crank lever mechanism rotates or swings to its second position, that the pawl projections will now slide along the peripheral edge portions of the strap which overlie the second surface of the plate means, the second surface 78 being parallel to the reciprocal movement imparted to the bell crank lever mechanism by the reciprocal means, and the strap may now slide between the pawl projections and the upper surface 78 in the direction indicated by the arrow 244. As can be seen from a comparison of FIGS. 11 and 12, the free end portion 16 of the strap will be held under tension the instant before the tension within the strap equals the tension of the force applying means. However, when the bell crank lever means shifts to its second position the tension is released on the strap, and the free end of the strap will move in the direction of the arrow 244 until the vanes 26 of the superimposed portions of the strap within the clip 20 inter-engage with each other to lock the strap in its desired final position.

When the bell crank lever mechanism 80 shifts to its second position, the right-hand end of the mechanism 80 will be shifted downwardly, causing the abutment means or surface 236 of the slides 174 also to be shifted downwardly. If the abutment means is not overlying the upper surface of the slides 212 when this event occurs, further movement of the handle in the direction of the arrow 228 will cause the reciprocal shearing means to be moved upwardly and to the left in the direction indicated by the arrow 246 in FIG. 8 to shear the free end 16 closely adjacent to the bundle tie. If the bell crank lever mechanism 80 were to be shifted to its second position when in the FIG. 6 position, the lower end of the slides 174 could not move downwardly as they are overlying the top surface of slides 212. In this situation, the springs 184 would be compressed and the slides 174, which are normally disposed in an extended position as shown in the various Figures, would be shifted to their retracted position. If the handle 88 is now released, the spring 124 will shift the tensioning means in a direction opposite to the arrow 226, which will in turn cause the bell crank lever mechanism to be shifted to its first position until the tensioning means attains its forward position shown in FIG. 5. Then, further reciprocation of the tensioning means in the direction of the arrow 226 will initially cause the bell crank lever mechanism to swing to the position shown in FIG. 7, and further similar movement of the tensioning means will initially cause the abutment surfaces 236 to contact the left-hand surfaces 234 of the slides 212, and continued movement will then cause the cutting means to be actuated. At this time the strap is not being tensioned, and therefore less force is required to cut the strap than if it were necessary to apply tension to the strap 16.

The reciprocal shearing means is caused to be moved upwardly in the direction indicated by the arrow 246 by movement of the slides 212 in the direction of the arrow 248, this movement being imposed upon the slides 212 by the action of the slides 174 when the actuator means causes tensioning means to move in the direction of the arrow 226. As the slides 212 move in the direction of the arrow 248, they will cause the bell crank lever means 202 to rotate in the direction of the arrows 249 about the pivot pin 206. This will in turn cause the links 198, the movable mounting member 194, and the movable shear blade 188 to be moved in the direction of the arrow 246 to cause the free end of the strap to be sheared.

After the strap has been cut, the handle will be released and the tensioning means will be biased to the left by the action of the spring 124. At the same time, the slides 212 will be moved in a direction opposite to the arrow 248 and the reciprocal shearing means will be biased in a direction opposite to the arrow 246 by the action of a tension spring 250 which has one end interconnected with a projection 252 carried by the mounting block 52 and the other end interconnected to a projection 254 carried by the bell crank member 202.

The tool of this invention requires less force to cut a strap as the cutter mechanism can only be actuated in response to the relaxation of the tension on the free end of the strap and thus, it is not necessary to additionally apply force to tension the strap during the cutting operation.

While a preferred structure in which the principles of the present invention have been incorporated is shown and described above, it is to be understood that the invention is not to be limited to the particular details, shown and described above, but that, in fact, widely differing means may be employed in the practice of the broader aspects of this invention.

What is claimed is:

1. A tool adapted to receive the free end of a self-locking bundle tie which has a loop disposed about a bundle, to tighten said loop by applying tension to the free end of the bundle tie, to discontinue tightening said loop when the desired tension is achieved within the loop by relaxing the tension applied to the free end of the bundle tie, and to cut the free end of the bundle tie after the tension has been relaxed; said tool comprising;

plate means;

tensioning means including a bell crank lever mechanism having pawl means mounted on one end, said free end of the bundle tie extending between said pawl means and said plate means, mounting means for mounting the bell crank lever mechanism for reciprocal movement and also for swinging shifting movement between a first tension applying position and a second position, and reciprocal means interconnected with the mounting means and operable to reciprocate the mounting means and the bell crank lever mechanism, said tensioning means being operable when the bell crank lever mechanism is in its first position to exert tension on the free end of the bundle tie during reciprocation of the bell crank lever mechanism in one direction to tighten said loop disposed about said bundle, and, when the bell crank lever mechanism is in its second position being unable to tighten said loop about said bundle during reciprocation of the bell crank lever mechanism in said one direction; and cutting means operable to cut the free end of the bundle tie during reciprocation of the bell crank lever mechanism in said one direction only after said bell crank lever mechanism has shifted to the second position.

2. The tool set forth in claim 1 in which said mounting means includes pivot means extending through an intermediate portion of said bell crank lever mechanism; and a pair of spaced apart slides provided with aligned elongated slots, spaced apart end portions of said pivot means being received within said elongated slots;

the parts being so arranged and constructed that when the bell crank lever mechanism is in its first tension applying position the spaced apart end portions of said pivot means will be disposed in one end of the elongated slots, and when the bell crank lever mechanism is shifted to its second position the bell crank lever mechanism will pivot about the axis of the pivot means as the end portions of the pivot means shift away from said one end of the elongated slots.

3. The tool set forth in claim 1 wherein the force exerted by the reciprocal means upon said bell crank lever mechanism when tensioning said free end tends to swing said bell crank lever mechanism towards its second position; and force applying means operable to exert an opposing force upon said bell crank lever mechanism to maintain the bell crank lever mechanism in its first tension applying position until the bell crank lever mechanism is swung to its second position when the force exerted by the reciprocal means upon the bell crank lever mechanism during tensioning of the free end of the bundle tie exceeds the force exerted by the force applying means upon the bell crank lever mechanism.

4. The tool set forth in claim 3, in which said reciprocal means includes a reciprocal draw bar, means engagable with one end of said draw bar to selectively move said draw bar in a first direction, spring means interconnected with said draw bar and operable to bias said draw bar in a second direction, and means interconnecting the other end of said draw bar with said mounting means.

5. The tool set forth in claim 3 wherein said plate means has first and second surfaces disposed at an obtuse angle relative to each other, the second surface being generally parallel to the reciprocal movement imparted to the bell crank lever mechanism by said reciprocal means, said pawl means engaging the free end of the bundle tie at a location above the first surface during tensioning of said bundle tie, and the pawl means sliding along the surface of the free end of the bundle tie to a second location spaced above the second surface of the plate means after the desired tension has been achieved.

6. The tool set forth in claim 5 wherein said plate means is mounted for reciprocal sliding movement.

7. A tool adapted to receive the free end of a self-locking bundle tie which has a loop disposed about a bundle, to tighten said loop by applying tension to the free end, to discontinue tightening said loop when the desired tension is achieved within the loop by relaxing the tension applied to the free end of the bundle tie, and to cut the free end of the bundle tie after the tension has been relaxed; said tool comprising:

plate means;

tensioning means including a bell crank lever mechanism having pawl means mounted on one end, said free end of the bundle tie extending between said pawl means and said plate means, mounting means mounting the bell crank lever mechanism for reciprocal movement and also for shifting movement between a first tension applying position and a second position, said mounting means including pivot means extending through an intermediate portion of said bell crank lever mechanism, and a pair of spaced apart slides provided with aligned elongated slots, spaced apart end portions of said pivot means being received within said elongated slots, reciprocal means interconnected with the mounting means and operable to reciprocate the mounting means and the bell crank lever mechanism to cause said bell crank lever mechanism to exert tension on said free end of the bundle tie during reciprocation in one direction when the bell crank lever mechanism is in its first tension applying position, the forces exerted upon said bell crank mechanism when tensioning said free end tending to swing said bell crank lever mechanism towards its second position; and force applying means operable to exert force upon said bell crank lever mechanism to maintain the bell crank lever mechanism in its first tension applying position until the bell crank lever mechanism is swung to its second position, said bell crank lever mechanism being swung to its second position when the force exerted by the reciprocal means during tensioning of the free end of the bundle tie exceeds the force exerted by the force applying means upon the bell crank lever mechanism, the force applying means including compression spring means having one end engagable with the end of the bell crank lever mechanism remote from said pawl means, the force exerted by said spring means extending in a line substantially to one side of the pivot means when the bell crank lever means is in its first tension applying position to thereby resist the swinging force initially applied on the bell crank lever mechanism by the reciprocal means when initially exerting tension on the free end of the bundle tie; and cutting means operable to cut the free end of the bundle tie only after said bell crank lever mechanism has shifted to its second position.

8. The tool set forth in claim 7 in which said force applying means further includes adjustable means to vary the force exerted by said compression spring means whereby the desired tension which may be applied to the free end of the bundle tie may be varied as the force of the compression spring means is varied.

9. The tool set forth in claim 8 in which said adjustable means is a rotatable cam means having a plurality of faces spaced varying distances from the axis of rotation of the cam means, one of said faces being selectively engagable by the other end of said compression spring means.

10. The tool set forth in claim 7 in which said compression spring means includes an apertured spring holder, a plurality of Belleville springs mounted within the aperture of the spring holder, and a cylindrical spacer mounted within the aperture, one end of the spring holder engaging one end of the bell crank lever mechanism, and the cam means engaging one end of the cylindrical spacer.

11. A tool for tightening the loop of a self-locking bundle tie about a bundle and for subsequently cutting the free end of the bundle tie; a tool comprising:

a frame;

cutter means mounted within said frame and operable when actuated to cut the free end of the bundle tie;

a strap engaging mechanism;

mounting means for mounting said strap engaging mechanism within said frame for reciprocal movement and for swinging movement between a first tightening position and a second position where it is incapable of tightening the loop about a bundle, said strap engaging mechanism being operatively interconnectable with said cutter means only when in the second position; and means operable to reciprocate said mounting means towards and away from said bundle;

the parts being so arranged and constructed that when the strap engaging mechanism is in its first tightening position and reciprocated away from said bundle it will cause the loop to be tightened about said bundle, and when the strap engaging mechanism is in the second position and reciprocated away from said bundle it will initially engage the cutter means and will subsequently cause the cutter means to cut the free end of the strap during continued movement of the strap engaging mechanism away from said bundle.

12. The tool set forth in claim 11 in which said cutter means includes reciprocal shearing means, a slide mechanism, and lever means being interconnected at one end to said shearing means and being interconnected at its other end to said slide mechanism, the strap engaging mechanism engaging said slide mechanism when it is in its second position during reciprocation of the mounting means away from said bundle.

13. The tool set forth in claim 11 in which the strap engaging mechanism includes abutment means, said abutment means being incapable of being operatively interconnected with said cutter means when the strap engaging mechanism is in the first tightening position, said abutment means engaging the cutter means when the strap engaging mechanism is in its second position to cause said cutter means to cut the free end of the bundle tie during reciprocation of the strap engaging mechanism away from said bundle.

14. The tool set forth in claim 13 in which the cutter means includes a reciprocal slide member normally spring biased towards the bundle, said slide mechanism having a forward abutment surface, and the abutment means of the strap engaging mechanism being shiftable between extended and retracted positions and normally being spring biased towards an extended position and movable towards a retractable position should the strap engaging mechanism be shifted to its second position when the abutment means is disposed over said slide mechanism.

15. The tool set forth in claim 14 in which said cutter means further includes reciprocal shearing means, spring means operable to normally bias the reciprocal shearing means away from the free end of the bundle tie, and lever means, an intermediate portion of the lever means being pivotally interconnected to said frame, and spaced apart end portions of the lever means being pivotally interconnected to the shearing means and the slide mechanism, respectively.

16. A tool adapted to receive the free end of a self-locking bundle tie formed of stainless steel or the like, the bundle tie having a loop disposed about a bundle, said tool being adapted to tighten the loop about the bundle and to subsequently cut the free end of the bundle tie; said tool comprising:

a generally longitudinally extending frame having one end adapted to be disposed adjacent said bundle;

plate means mounted within said frame means adjacent said one end;

tensioning means including a strap engaging mechanism having pawl means mounted on one end, said free end of the bundle tie extending between said pawl means and said plate means;

cutter means mounted within said frame and operable to cut the free end of said strap only after the loop of the bundle tie has been tightened about a bundle;

actuator means operatively interconnected to said tensioning mens and operative during movement in one direction to either tighten the loop of the self-locking bundle tie about the bundle or to cut the free end of the bundle tie, said actuator means being mounted on the other end of the frame and including a handle and force multiplying means interconnecting said handle to the tensioning means; and mounting means for mounting the strap engaging mechanism within the frame for swinging movement between a first tightening position and a second position where it is incapable of tightening the loop about the bundle, said strap engaging mechanism being operatively interconnected with said cutter means only when it is in its second position, and said actuator means being operatively interconnected to said cutter means through said strap engaging mechanism when said strap engaging mechanism is in its second position.

17. The tool set forth in claim 16 wherein said mounting means includes:

pivot means extending through an intermediate portion of a strap engaging mechanism, and a pair of spaced apart slides provided with aligned elongated slots, spaced apart end portions of the pivot means being received within said elongated slots, the parts being so arranged and constructed that when the strap engaging mechanism is in its first tightening position the spaced apart end portions of the pivot means will be disposed in one end of the elongated slots, and when the strap engaging mechanism is shifted to its second position the strap engaging mechanism will pivot about the axis of the pivot means as the end portions of the pivot means shift away from said one end of the elongated slots.

18. A tool for tightening the loop of a self-locking bundle tie about a bundle and for subsequently cutting the free end of the bundle tie; said tool comprising:

a generally longitudinally extending frame having one end adapted to be disposed adjacent said bundle;

plate means mounted within said frame adjacent said one end;

cutter means mounted within said frame and operable when actuated to cut the free end of the bundle tie;

a strap engaging mechanism;

mounting means for mounting said strap engaging mechanism within said frame for reciprocal movement and for swinging movement between a first tightening position and a second position where it is incapable of tightening the loop about a bundle;

means operable to reciprocate said mounting means towards and away from said bundle; and a back latch mechanism engagable with the free end of the bundle tie only when the mounting means is being reciprocated towards said bundle, said back latch mechanism including a stationary upwardly projecting portion mounted within the frame adjacent one end of the plate means and between the strap engaging mechanism and said one end of the frame.

* * * * *